US007963579B2

(12) United States Patent
Waisanen

(10) Patent No.: US 7,963,579 B2
(45) Date of Patent: Jun. 21, 2011

(54) SELF-LEVELING BOTTOM BLOCK ASSEMBLY

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 710 days.

(21) Appl. No.: 11/943,635

(22) Filed: Nov. 21, 2007

(65) Prior Publication Data

US 2008/0116433 A1 May 22, 2008

Related U.S. Application Data

(60) Provisional application No. 60/860,651, filed on Nov. 22, 2006.

(51) Int. Cl.
*B66C 1/34* (2006.01)

(52) U.S. Cl. ..... 294/82.12; 212/274; 212/326; 212/327; 254/280

(58) Field of Classification Search ..... 294/82.12, 294/82.15, 67.5, 86.41; 254/278, 280, 294, 254/316, 318; 212/274, 326, 327
See application file for complete search history.

(56) References Cited

U.S. PATENT DOCUMENTS

| | | | | | |
|---|---|---|---|---|---|
| 2,306,055 | A | * | 12/1942 | Harry | 212/319 |
| 2,546,683 | A | * | 3/1951 | Young | 254/399 |
| 2,820,624 | A | * | 1/1958 | Koegel | 177/147 |
| 2,960,310 | A | * | 11/1960 | Hull | 254/337 |
| 2,994,513 | A | * | 8/1961 | Bowerman et al. | 254/337 |
| 3,936,034 | A | * | 2/1976 | Larralde | 254/399 |
| 4,073,476 | A | * | 2/1978 | Frank | 254/285 |
| 4,360,112 | A | * | 11/1982 | Brewer et al. | 212/312 |
| 4,597,497 | A | * | 7/1986 | Aberegg | 212/274 |
| 5,603,420 | A | * | 2/1997 | Swanson | 212/274 |

* cited by examiner

*Primary Examiner* — Saúl J Rodríguez
*Assistant Examiner* — Stephen Vu
(74) *Attorney, Agent, or Firm* — Porter, Wright, Morris & Arthur, LLP

(57) ABSTRACT

A bottom block assembly includes a block having a central vertical axis, a hook secured to the block for attaching a load to the block, a first pair of sheaves rotatably attached to the block, a first rope reeved about the first pair of sheaves, a second pair of sheaves rotatably attached to the block, and a second rope reeved about the second pair of reeves. The first and second pairs of sheaves are each equally spaced about the central vertical axis. The first pair of sheaves are located higher on the block than the second pair of sheave so that a portion of the first rope located between the first pair of sheaves crosses over a portion of the second rope located between the second pair of sheaves. If either rope fails, the other rope ensures the block remains level with a full load attached to the hook.

20 Claims, 5 Drawing Sheets

SELF-LEVELING BOTTOM BLOCK ASSEMBLY

CROSS-REFERENCE TO RELATED APPLICATIONS

This application claims the benefit of Provisional Patent Application No. 60/860,651 filed on Nov. 22, 2006, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The field of the present invention generally relates to lift cranes and, more particularly, to bottom block assemblies of overhead cranes.

BACKGROUND OF THE INVENTION

Conventional overhead lift cranes include at least one bottom block that, in combination with a trolley hoist assembly having a hoist drum, raise and lower a load hook or other lifting mechanism attached to the bottom block. Each bottom block with its attached load hook is designed to handle a certain maximum load. Each bottom block typically includes a pair of sheaves with two ropes reeved between the pair of sheaves and the hoist assembly so that each sheave is supported by a single one of the two ropes. In this configuration, if one of the two ropes breaks, any load attached to the hook moves in an uncontrolled manner and does not remain level.

One prior solution to solve this problem uses four ropes to support the bottom block. If any one of the four ropes breaks, the bottom block remains level even with a full load attached to the hook. However, four ropes occupy a larger portion of a hoist drum. Thus, a larger hoist drum is required which increases the trolley spread and the overall weight of the trolley hoist assembly.

There is a need in the industry to provide lift cranes that are single failure proof. There is also a never ending need in the industry to provide lift cranes of reduced size and weight without sacrificing lift capabilities. Accordingly, there is a need in the art for an improved a bottom block assembly for use with a lift crane.

SUMMARY OF THE INVENTION

The present invention provides a bottom block assembly for use with an overhead crane which addresses at least some of the above-noted problems of the related art. According to the present invention, a bottom block assembly for a crane comprises, in combination, a block having a central vertical axis, a hook secured to the block for attaching a load to the block, a first pair of sheaves rotatably attached to the block, a first rope reeved about the first pair of sheaves, a second pair of sheaves rotatably attached to the block, and a second rope reeved about the second pair of reeves. If either the first rope or the second rope fails, the other of the first rope and the second rope ensures that the block remains level with a full load attached to the hook.

According to another aspect of the present invention, a bottom block assembly for a crane comprises, in combination, a block having a central vertical axis, a hook secured to the block for attaching a load to the block, a first pair of sheaves rotatably attached to the block, a first rope reeved about the first pair of sheaves, a second pair of sheaves rotatably attached to the block, and a second rope reeved about the second pair of reeves. The first pair of sheaves are equally spaced about the central vertical axis and the second pair of sheaves are equally spaced about the central vertical axis. A portion of the first rope located between the first pair of sheaves crosses a portion of the second rope located between the second pair of sheaves when viewed from above.

According to yet another aspect of the present invention, a bottom block assembly for a crane comprises, in combination, a block having a central vertical axis, a hook secured to the block for attaching a load to the block, a first pair of sheaves rotatably attached to the block, a first rope reeved about the first pair of sheaves, a second pair of sheaves rotatably attached to the block, and a second rope reeved about the second pair of reeves. The first pair of sheaves are equally spaced about the central vertical axis and the second pair of sheaves are equally spaced about the central vertical axis. The first pair of sheaves are located higher on the block than the second pair of sheaves so that a portion of the first rope located between the first pair of sheaves crosses over a portion of the second rope located between the second pair of sheaves. If either the first rope or the second rope fails, the other of the first rope and the second rope ensures that the block remains level with a full load attached to the hook.

From the foregoing disclosure and the following more detailed description of various preferred embodiments it will be apparent to those skilled in the art that the present invention provides a significant advance in the technology of bottom block assemblies. Particularly, the invention provides a single failure proof bottom block assembly which is self leveling and enables lift cranes of relatively small spread. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
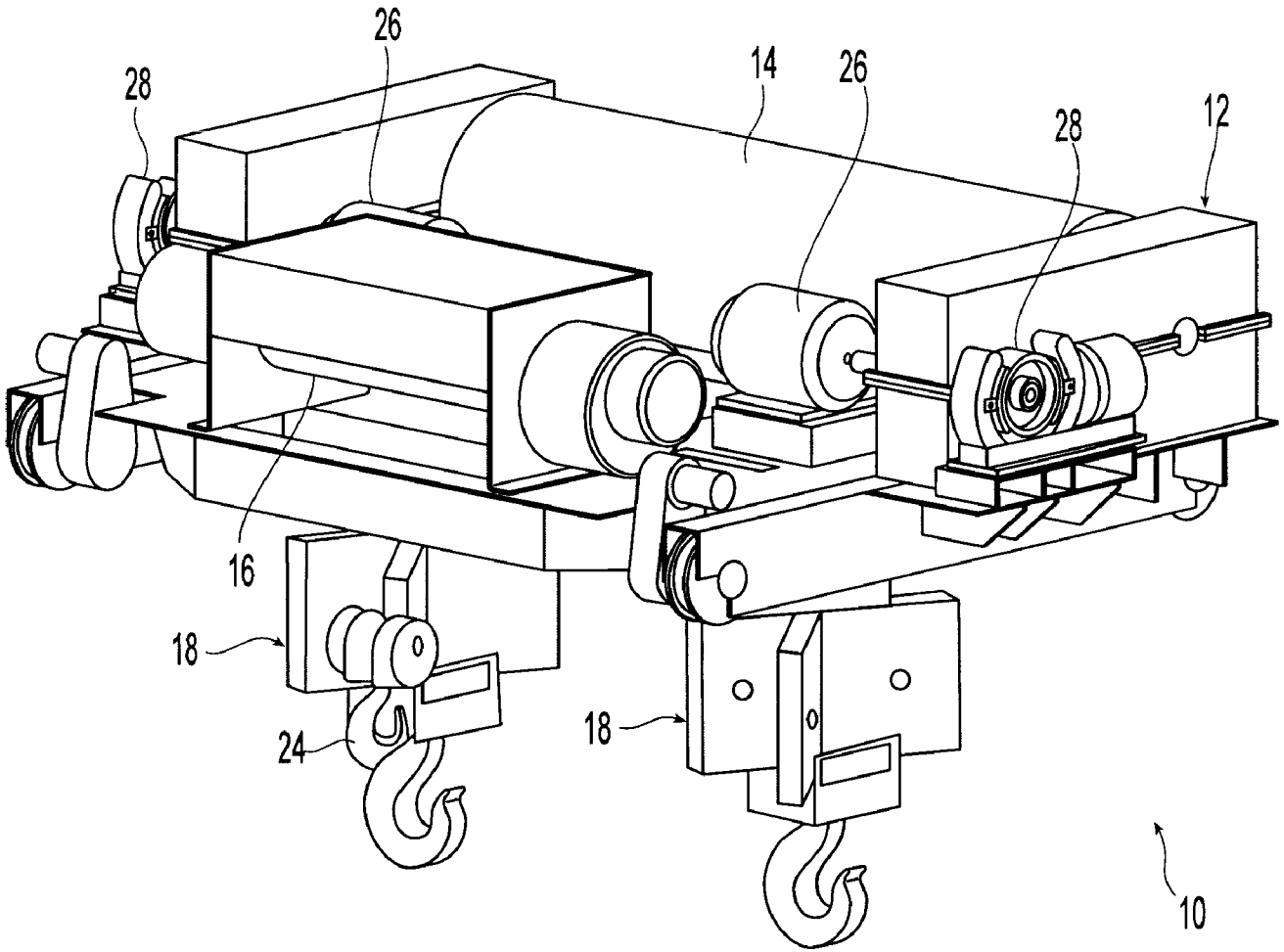
FIG. 1 is a perspective view of a trolley hoist assembly according a preferred embodiment of the present invention.
Figure 2:
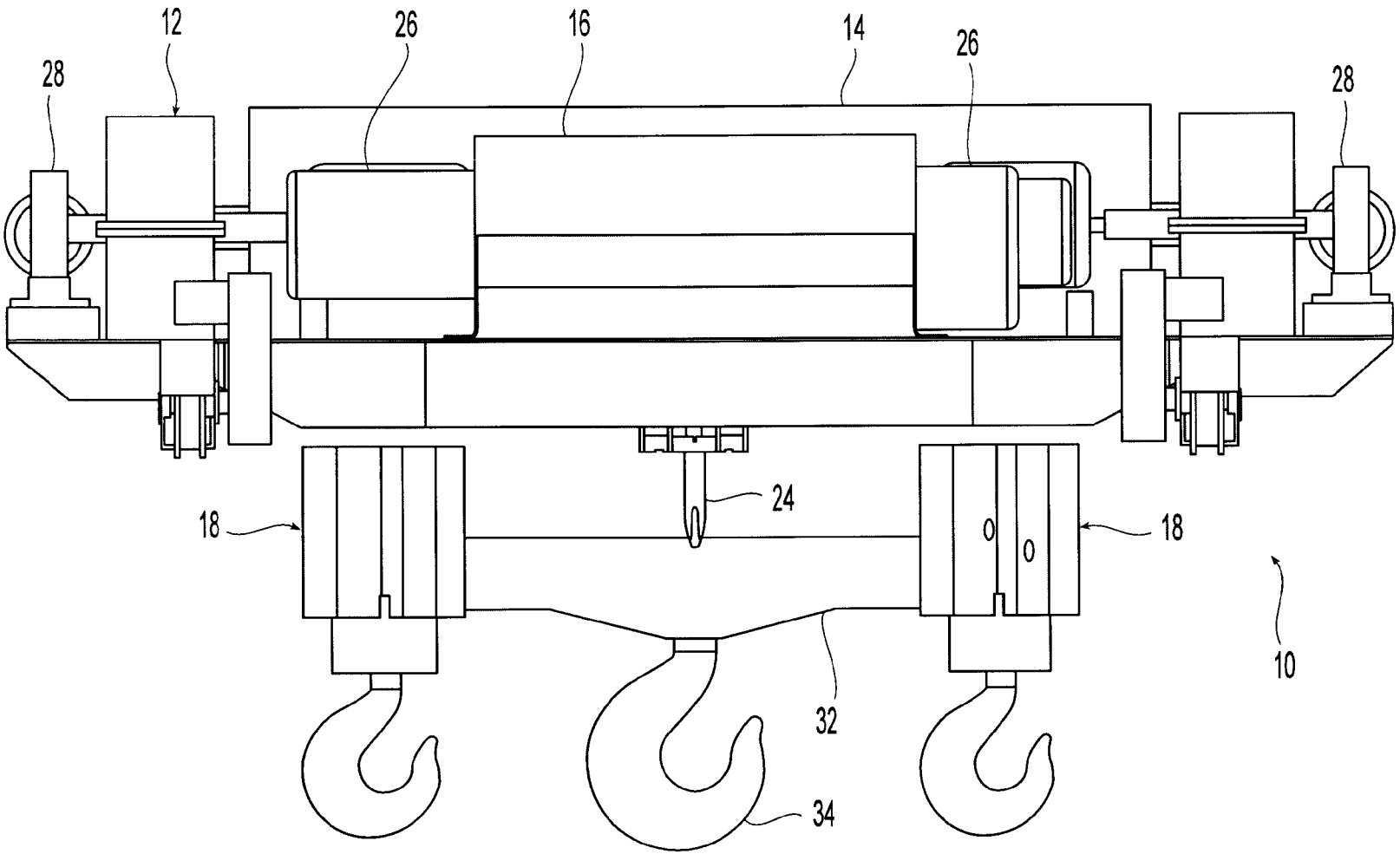
FIG. 2 is an end elevational view of the trolley hoist assembly of FIG. 1.
Figure 3:
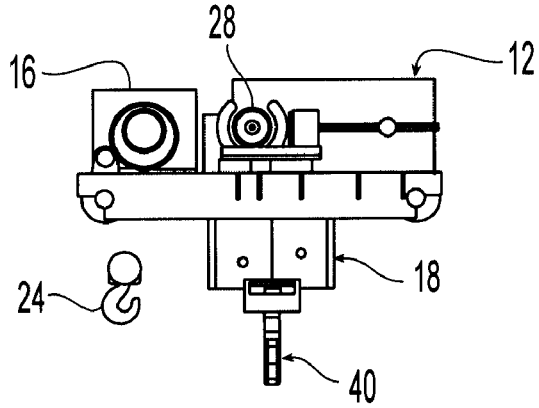
FIG. 3 is side elevational view of the trolley hoist assembly of FIGS. 1 and 2.
Figure 4:
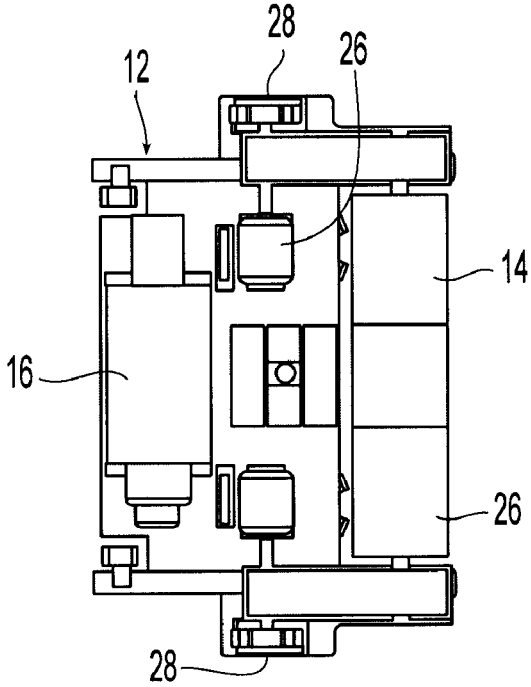
FIG. 4 is top plan view of the trolley hoist assembly of FIGS. 1 to 3.
Figure 5:
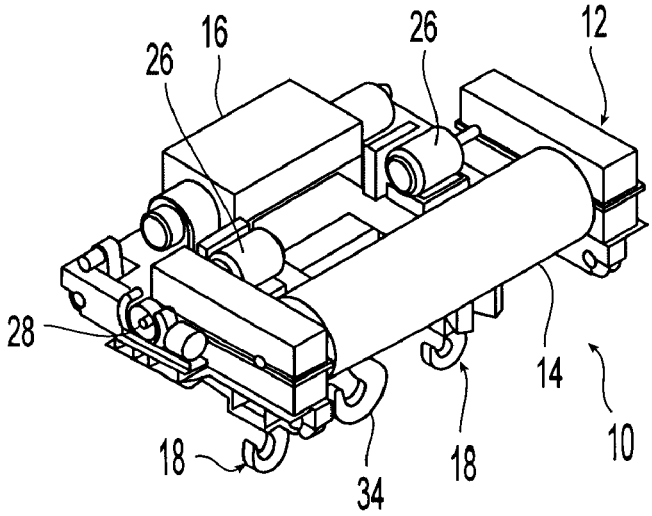
FIG. 5 is a perspective view of the trolley hoist assembly of FIGS. 1 to 4.

It should be understood that the appended drawings are not necessarily to scale, presenting a somewhat simplified representation of various preferred features illustrative of the basic principles of the invention. The specific design features of the bottom block assembly as disclosed herein, including, for example, specific dimensions, orientations, and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the bottom block assembly illustrated in the drawings. In general, up or upward refers to an upward direction generally within the plane of the paper in FIG. 2 and down or downward refers to a downward direction generally within the plane of the paper in FIG. 2. Also in general, fore or forward refers to a direction generally out of the plane of the paper in FIG. 2 and aft or rearward refers to a direction generally into the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved lower block assembly for a lift crane disclosed herein. The following detailed discussion of various alternative and preferred embodiments will illustrate the general principles of the invention with reference to an overhead crane. Other embodiments suitable for other applications will be apparent to those skilled in the art given the benefit of this disclosure.

FIGS. 1 to 5 illustrate a trolley hoist assembly 10 for an overhead crane according to the present invention. The illustrated trolley hoist assembly 10 includes a trolley 12, a hoist drum 14 carried by the trolley 12, an upper block assembly 16 carried by the trolley 12, a pair of self-leveling bottom block assemblies 18 which engage loads to be lifted, and a plurality of wire ropes 20, 22 which extend from the drum to the bottom block assemblies 18 and back to the upper block assembly 16. The trolley 12 moves along a pair of spaced-apart rails (not shown) that sit on girders (not shown) that translate along spaced-apart main support beams (not shown). The translation of the trolley 12 along the rails and the translation of the rails along the beams allows the crane to position the bottom block assemblies 18 virtually anywhere along the linear path along which the crane is installed. The illustrated trolley hoist assembly 10 also includes an auxiliary lift hook 24.

The drum 14 is rotatably mounted to the trolley 12 about a horizontal axis of rotation and is operably connected to a motor 26 by suitable speed reducers 28. The wire ropes 20, 22 extend from the drum 14 to the bottom block assemblies 18 which each include a plurality of sheaves 30 around which the wire ropes 20, 24 pass as will be described in more detail hereinafter. From the bottom block assemblies 18, the wire ropes 20, 22 extend to the upper block 16. As the drum 14 is rotating in one direction to wind up the wire ropes 20, 24, the bottom block assemblies 18 are lifted. As the drum 14 is rotating in the other direction to unwind the wire ropes 20, 24, the bottom block assemblies 18 are lowered.

In the illustrated embodiment, two of the bottom blocks assemblies are used and a lifting beam 32 extends between and is coupled to the bottom block assemblies 18. The lifting beam 32 also includes a centrally located hook 34 for lifting a load. While the illustrated trolley hoist assembly 10 has a dual bottom block configuration, it should be readily apparent to those of skill in the art that the trolley hoist assembly 10 may include fewer or more of the bottom block assemblies 18. It should also be readily apparent to those of skill in the art that the bottom block assembly 18 and the lifting beam 32 may include other configurations for lifting a load, as known in the art.

Figure 6:
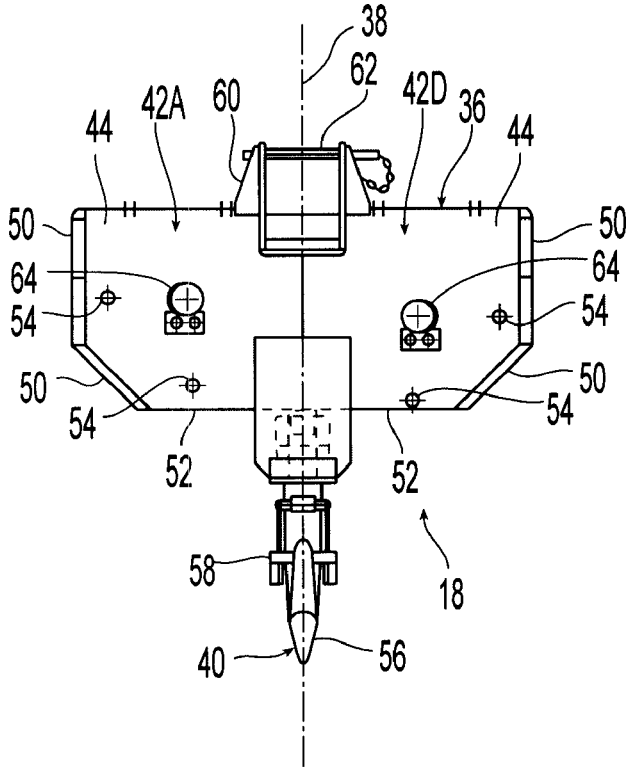
FIG. 6 is a side elevational view of a bottom block assembly of the trolley hoist assembly of FIGS. 1 to 5.
Figure 7:
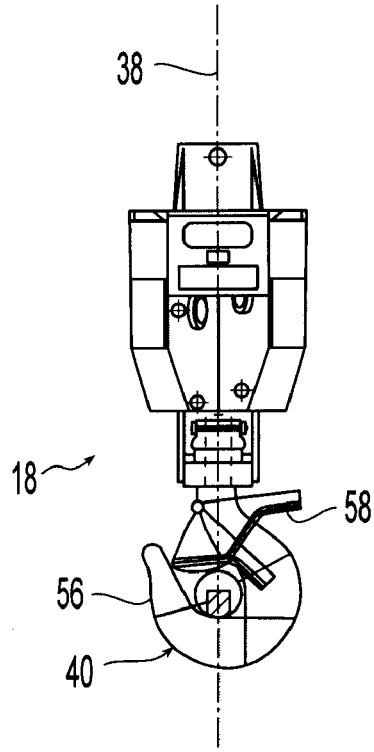
FIG. 7 is top plan view of the bottom block assembly of FIG. 6.
Figure 8:
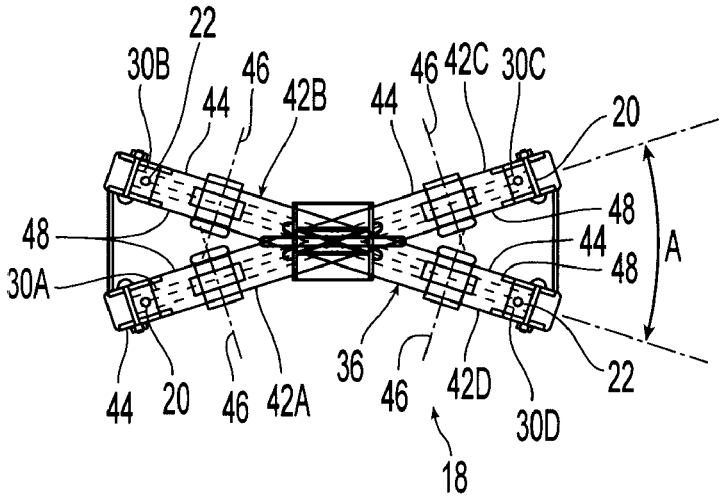
FIG. 8 is an end elevational view of the bottom block assembly of FIGS. 6 and 7.

FIGS. 6 to 8 illustrate the bottom block assembly 18 which includes a frame or block 36 having a central vertical axis 38, a hook assembly 40 secured to the block 36 at the central vertical axis 38 for attaching a load to the block 36, a first pair of the sheaves 30A, 30C rotatably attached to the block 36 with the first rope 20 reeved about the first pair of sheaves 30A, 30C, and a second pair of sheaves 30B, 30D rotatably attached to the block 36, with the second rope 22 reeved about the second pair of reeves 30B, 30D. The illustrated bottom block assembly 18 is single failure proof (SFP) and self leveling to ensure that upon failure of a single one of the ropes 20, 22, the bottom block hook 36 will remain level, even while supporting a full load.

In the illustrated embodiment, each bottom block assembly 18 has a twenty ton lifting capacity and the lifting beam has a forty ton lifting capacity. It should be readily apparent to those skilled in the art that in further embodiments the bottom block assembly 18 and the lifting beam can have larger or smaller lifting capacities depending on the requirements of the application.

The illustrated block 36 includes four end portions 42A, 42B, 42C, 42D that extend from a central area at the vertical central axis 38 to form a generally X-shaped configuration when viewed from above. Each of the illustrated end portions 42A, 42B, 42C, 42D include a pair of vertically extending sheets or plates 44 that are parallel and spaced apart. The plates 44 are spaced-apart a distance adequate for supporting the sheaves 30 therebetween. The plates 44 of the illustrated first and third end portions 42A, 42C are aligned so that they rotational axes 46 of the first pair of sheaves 30A, 30B are substantially parallel and the illustrated second and fourth end portions 42B, 42D are aligned so that the rotational axes 46 of the second pair of sheaves 30C, 30D are substantially parallel. The first and third end portions 42A, 42C form an angle A with the second and fourth end portions 42B, 42D, when viewed from above, that is preferably less than 90 degrees, is more preferably in the range of from about 20 degrees to about 50 degrees, and is even more preferably about 35 degrees. The illustrated block further includes top covers 48, side covers 50, and bottom covers 52 which partially close the edges of the plates 44. The covers can be secured to the plates in any suitable manner such as the illustrated mechanical fasteners 54.

The illustrated hook assembly 40 includes a hook 56 that is rotatably coupled to an underside of the block 36 and is positioned to rotate about the central vertical axis 38. The hook 56 can be secured to the block 36 in any suitable manner. The illustrated hook is provided with latch 58.

The illustrated bottom block assembly 18 also includes a bracket 60 at a top of the block 36 and a pin 62 for removably coupling the lifting beam 32, as discussed above, to the bottom block assemblies 18. It is noted that the lifting beam 32 can alternatively be coupled to the bottom block assemblies in another suitable manner.

A single one of the sheaves 30A, 30B, 30C, 30D is positioned in each of the end portions 42A, 42B, 42C, 42D between the plates 44 and is rotatably coupled to the plates 44 by a pin and bearing assembly 64. The illustrated plates 44 are provided with openings for receiving the pins or axles therein. The first pair of sheaves 30A, 30C in the first and third end portions 42A, 42C are each positioned within the block 36 a first height H1 from the underside of the block 36. The second pair of sheaves 30B, 30D in the second and fourth end portions 42B, 42D are positioned within the block 36 at a second height H2 from the underside of the block 36. In the illustrated embodiment, the first height H1 is greater than the second height H2 so that the first pair of sheaves 30A, 30C are located on the block 36 higher than the second pair of sheaves 30B, 30D. The first and second pair of sheaves 30 are also each equally spaced about the central vertical axis 38.

Figure 10:
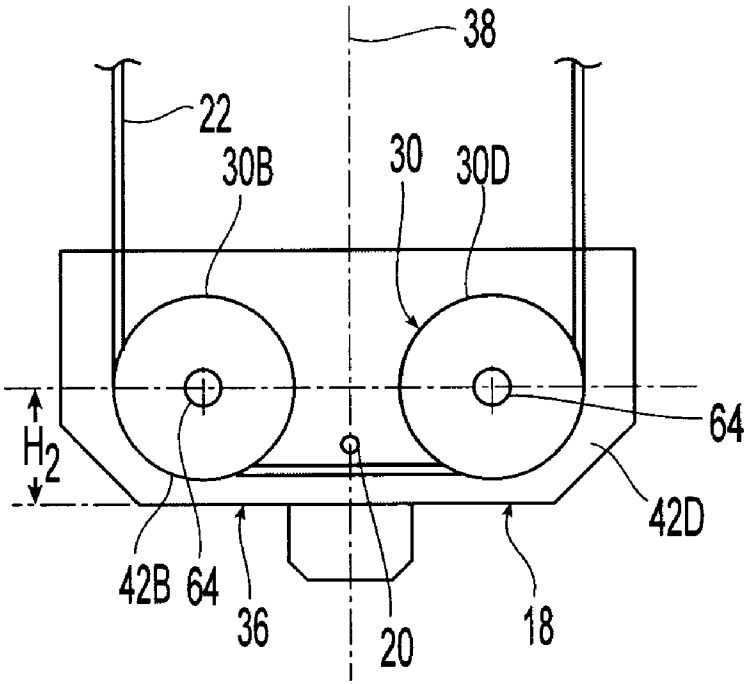
FIG. 10 is a diagrammatic view of a second pair of sheaves of the bottom block assembly of FIGS. 6 to 8.
Figure 9:
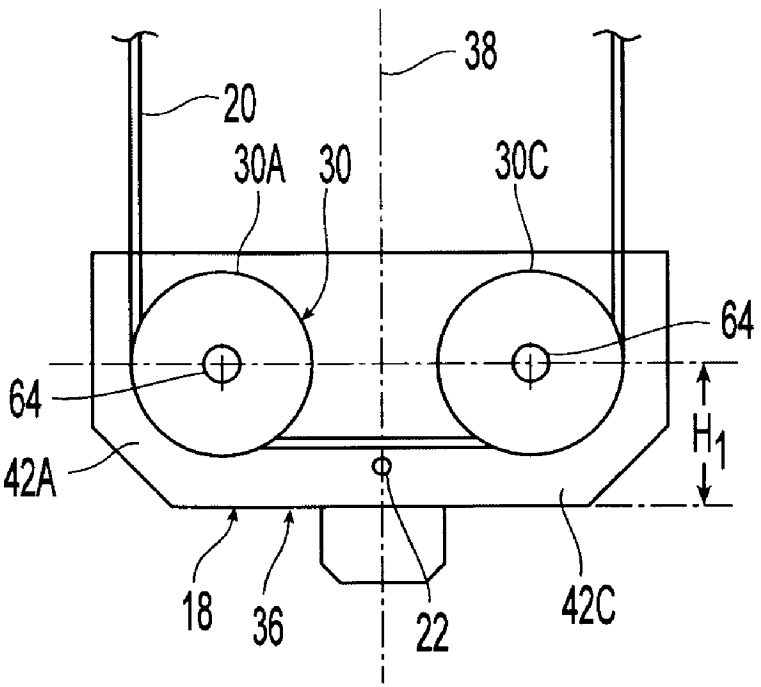
FIG. 9 is a diagrammatic view of a first pair of sheaves of the bottom block assembly of FIGS. 6 to 8.

The first and second wire ropes 20, 22 extend from the drum 14 and pass around the sheaves 30. As best shown in FIGS. 9 and 10, the first rope 20 extends from the drum 14 to the first sheave 30A of the bottom block assembly 18. After passing around the first sheave 30A, the first rope 20 extends horizontally across the first and third end portions 42A, 42C of the block to the third sheave 30C. The first rope 20 passes around the third sheave 30C and extends up to a termination point on the upper block assembly 16 of the trolley hoist assembly 10. The second rope 22 extends from the drum 14 to the second sheave 30B of the bottom block assembly 18. After passing around the second sheave 30B, the second rope 22 extends horizontally across the second and fourth end portions 42B, 42D of the block 36 to the fourth sheave 30D. The second rope 22 passes around the fourth sheave 30D and extends up to a termination point on the upper block assembly 16 of the trolley hoist assembly 10. It is noted that the illustrated second rope 22 is not reeved about the first pair of sheaves 30A, 30C and the illustrated first rope 20 is not reeved about the second pair of sheaves 30B, 30D.

In the illustrated embodiment, the first rope 20 passes above and crosses over the second rope 22 proximate the vertical central axis 38. It is noted however, that the sheaves 30 may alternatively be positioned such that the second rope 22 passes above the first rope 20. When a load is supported by the hook 22, the two ropes and sheave configuration ensure the load remains level. Also in the illustrated embodiment, a portion of the first rope 20 between the first pair of sheaves 30A, 30C and a portion of the second rope 20 between the second pair of sheaves 30B, 30D cross, when viewed from above, to preferably form an angle A of less than 90 degrees, more preferably an angle A in the range of about 20 degrees to 50 degrees, and even more preferably an angle A of about 35 degrees.

During use of the trolley hoist assembly 10 and the bottom block assembly 18 to lift a load, failure of one of the bottom block ropes 20, 22 may occur. Upon failure of one of the ropes 20, 22, the remaining, intact rope 20, 22 supports the bottom block 18 with respect to the trolley hoist 10. The bottom block 18 remains level to ensure the load supported buy the hook 56 remains level and does not move in an uncontrolled manner. The remaining rope 20, 22 extends between the two, opposed sheaves 30 and passes across the central axis 36 of the block 36 and the hook 56. Therefore, the remaining rope 20, 22 supports the load of the hook 56 centered about the hook 56, which keeps the bottom block assembly 18 and the load level.

It is apparent from the foregoing disclosure that bottom block assembly 18 is self-leveling and single failure proof. It is also apparent that the bottom block assembly 19 is supported by only two ropes 20, 22 and therefore reduces the necessary spread of the drum and as a result reduces the size and weight of the crane.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A bottom block assembly for a crane, said bottom block assembly comprising, in combination:

a block having a central vertical axis;

a hook secured to the block for attaching a load to the block;

a first pair of sheaves rotatably attached to the block;

wherein rotational axes of the first pair of sheaves are parallel and spaced apart about the central vertical axis;

a first rope reeved about the first pair of sheaves;

a second pair of sheaves rotatably attached to the block;

wherein rotational axes of the second pair of sheaves are parallel and spaced apart about the central vertical axis;

a second rope reeved about the second pair of sheaves; and wherein if either the first rope or the second rope fails, the other of the first rope and the second rope ensures that the block remains level with a full load attached to the hook.

2. The bottom block assembly according to claim 1, wherein the second rope is not reeved about the first pair of sheaves and the first rope is not reeved about the second pair of sheaves.

3. The bottom block assembly according to claim 1, wherein the first pair of sheaves and the second pair of sheaves are equally spaced about the central vertical axis.

4. The bottom block assembly according to claim 3, wherein a portion of the first rope between the first pair of sheaves and a portion of the second rope between the second pair of sheaves cross at the central vertical axis when viewed from above and form an angle of less than 90 degrees.

5. The bottom block assembly according to claim 4, wherein the angle is between about 20 degrees and 50 degrees.

6. The bottom block assembly according to claim 5, wherein the angle is about 35 degrees.

7. The bottom block assembly according to claim 3, wherein the first pair of sheaves are located higher on the block than the second pair of sheaves.

8. The bottom block assembly according to claim 3, wherein the portion of the first rope between the first pair of sheaves and the portion of the second rope between the second pair of sheaves form an angle of less than 90 degrees when viewed from above.

9. The bottom block assembly according to claim 8, wherein the angle is between about 20 degrees and 50 degrees.

10. The bottom block assembly according to claim 9, wherein the angle is about 35 degrees.

11. The bottom block assembly according to claim 1, wherein the first pair of sheaves are located higher on the block than the second pair of sheaves.

12. The bottom block assembly according to claim 11, wherein a portion of the first rope located between the first pair of sheaves crosses above a portion of the second rope located between the second pair of sheaves cross.

13. The bottom block assembly according to claim 1, wherein the block is X-shaped when viewed from above.

14. A bottom block assembly for a crane, said bottom block assembly comprising, in combination:

a block having a central vertical axis;

a hook secured to the block for attaching a load to the block;

a first pair of sheaves rotatably attached to the block;

wherein rotational axes of the first pair of sheaves are parallel and spaced apart about the central vertical axis;

a first rope reeved about the first pair of sheaves;

a second pair of sheaves rotatably attached to the block;

wherein rotational axes of the second pair of sheaves are parallel and spaced apart about the central vertical axis;

a second rope reeved about the second pair of sheaves;

wherein the first pair of sheaves and the second pair of sheaves are equally spaced about the central vertical axis; and wherein a portion of the first rope located between the first pair of sheaves crosses a portion of the second rope located between the second pair of sheaves at the central vertical axis when viewed from above.

15. The bottom block assembly according to claim 14, wherein if either the first rope or the second rope fails, the other of the first rope and the second rope ensures that the block remains level with a full load attached to the hook.

16. The bottom block assembly according to claim 14, wherein the second rope is not reeved about the first pair of sheaves and the first rope is not reeved about the second pair of sheaves.

17. The bottom block assembly according to claim 14, wherein the first pair of sheaves are located higher on the block than the second pair of sheaves.

18. The bottom block assembly according to claim 17, wherein the portion of the first rope located between the first pair of sheaves crosses above the portion of the second rope located between the second pair of sheaves cross.

19. The bottom block assembly according to claim 14, wherein the block is X-shaped when viewed from above.

20. A bottom block assembly for a crane, said bottom block assembly comprising, in combination:

a block having a central vertical axis;

a hook secured to the block for attaching a load to the block;

a first pair of sheaves rotatably attached to the block;

wherein rotational axes of the first pair of sheaves are parallel and spaced apart about the central vertical axis;

a first rope reeved about the first pair of sheaves;

a second pair of sheaves rotatably attached to the block;

wherein rotational axes of the second pair of sheaves are parallel and spaced apart about the central vertical axis;

a second rope reeved about the second pair of sheaves;

wherein the first pair of sheaves and the second pair of sheaves are equally spaced about the central vertical axis;

wherein the first pair of sheaves are located higher on the block than the second pair of sheaves so that a portion of the first rope located between the first pair of sheaves crosses over a portion of the second rope located between the second pair of sheaves at the central vertical axis; and wherein if either the first rope or the second rope fails, the other of the first rope and the second rope ensures that the block remains level with a full load attached to the hook.

* * * * *